United States Patent [19]

Bodine et al.

[11] Patent Number: 4,640,360

[45] Date of Patent: Feb. 3, 1987

[54] SONIC CEMENTING

[76] Inventors: Albert G. Bodine; James N. Gregory, both of 7877 Woodley Ave., Van Nuys, Calif. 91406

[21] Appl. No.: 789,447

[22] Filed: Oct. 21, 1985

[51] Int. Cl.[4] ..... E21B 33/14

[52] U.S. Cl. ..... 166/286; 166/177

[58] Field of Search ..... 166/286, 285, 177, 249

[56] References Cited

U.S. PATENT DOCUMENTS

| | | | |
|---|---|---|---|
| 3,239,005 | 3/1966 | Bodine, Jr. | 166/286 |
| 3,557,875 | 4/1969 | Solum | 166/177 X |
| 4,512,401 | 4/1985 | Bodine | 166/286 X |

*Primary Examiner*—Stephen J. Novosad

*Assistant Examiner*—Thuy M. Bui

*Attorney, Agent, or Firm*—Edward A. Sokolski

[57] ABSTRACT

In forming a cement annulus around a well casing to provide an impervious seal around such casing, sonic energy is applied from a sonic oscillator to the casing and transmitted down the casing to the work area. To improve the coupling of sonic energy through the casing to the work area, the oscillator is coupled to the casing wall below the cement inlet by means of a clamp and link coupler so as to minimize the dissipation of sonic energy in the cement inlet. Further, the cement is fed to this inlet by means of a flexible hose coupling to isolate the inlet coupling and associated hardware from the sonic energy.

4 Claims, 1 Drawing Figure

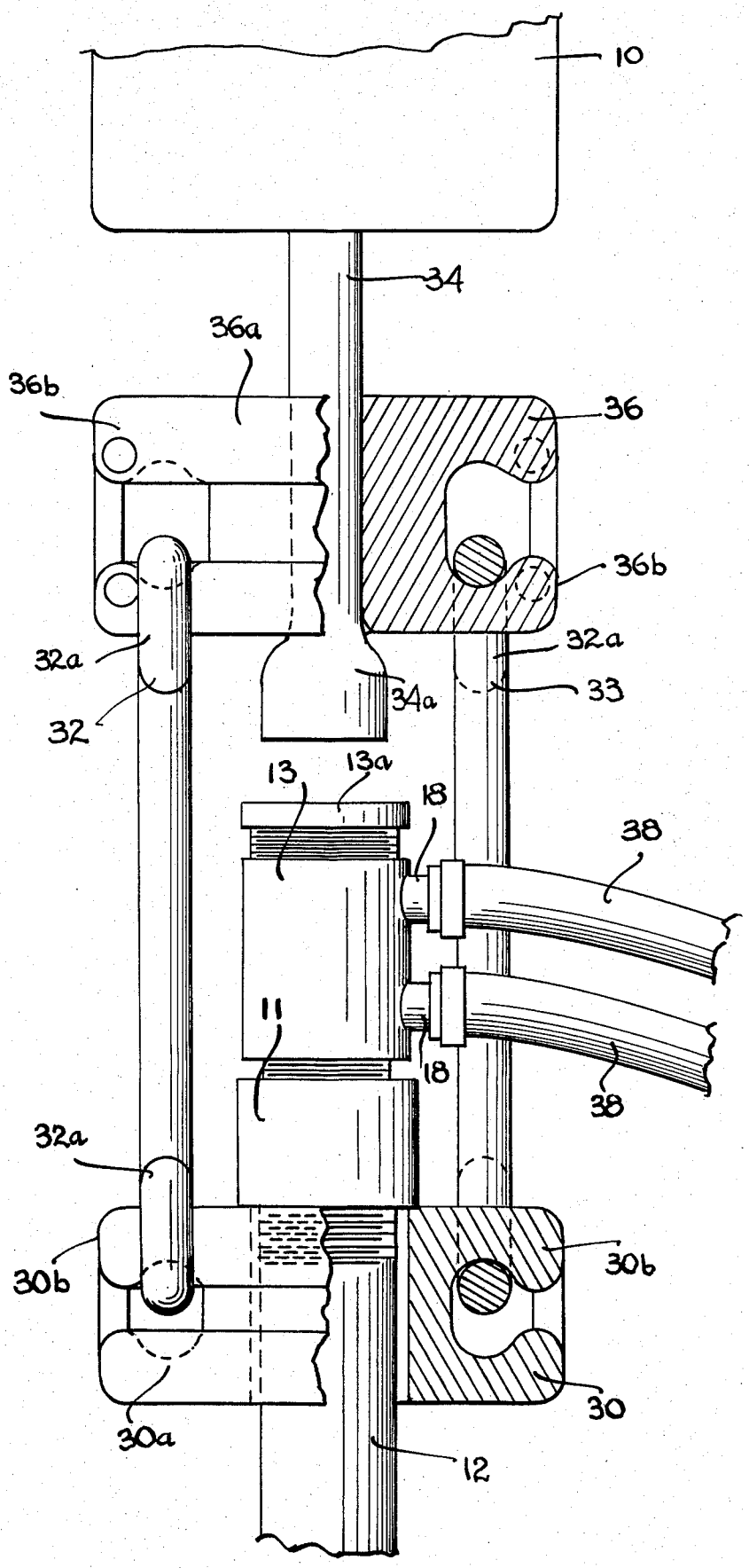
10
34
36a
36b
36
36b
32a
32a
33
32
34a
13
13a
18
38
11
18
38
32a
30b
30b
30
30a
12

SONIC CEMENTING

This invention relates to the formation of a cement annulus for a well employing sonic energy to facilitate such formation and more particularly to improved means for coupling the sonic energy to the well casing so as to minimize the wasteful dissipation of such energy.

In my U.S. Pat. No. 4,512,401 issued Apr. 23, 1985, a method for forming an annulus around the outer wall of a well casing to provide a good impervious seal around such casing is described. In carrying out this method, sonic energy at a relatively low frequency (typically 15–200 Hz) is applied to the casing. The sonic energy is applied to the top end of the casing from a sonic oscillator with cement being fed into the casing through an inlet located in the casing directly below the point thereon where the sonic oscillator is coupled, i.e. directly in the transmission path for the sonic energy. It has been found that this results in the dissipation of a substantial amount of sonic energy in the cement inlet and associated components which is highly undesirable, particularly in the case of deep wells where such energy dissipation cannot be tolerated.

The device of the present invention obviates the aforementioned shortcomings by providing a coupling between the oscillator and the well casing which bypasses the cement inlet and thus minimizes the dissipation of energy through this inlet.

This end result is achieved in the present invention by providing a pair of holder members one of which is directly connected to the casing at a point thereon below where the cement is fed into the casing and the other of which is connected directly to the oscillator. These two holder members are interconnected by link members by means of which the casing is suspended from the oscillator in good coupling engagement therewith. Coupler means which may take the form of flexible tubing is employed to feed the cement into the casing inlet, this inlet being located out of the direct sonic transmission path between the oscillator and the casing.

It is therefore an object of this invention to minimize the dissipation of sonic energy in the formation of a cement annulus around a well casing.

It is a further object of this invention to provide coupling means for coupling sonic energy from an oscillator to a well casing which bypasses an inlet for feeding cement and other material to the casing.

Other objects of this invention will become apparent as the description proceeds in connection with the accompanying drawing of which the sole FIGURE is an elevational view partially in cross section of a preferred embodiment of the invention.

Except for the sonic coupling mechanism to be described, the device of the present invention employs the same apparatus and operation as described in my aforementioned U.S. Pat. No. 4,512,401, the contents of that patent being incorporated herein by reference.

Referring now to the FIGURE, the sonic oscillator 10 which may be of the type described in my aforementioned U.S. Pat. No. 4,512,401 has a shaft 34 fixedly attached thereto as for example by welding, the shaft having a bulbous portion **34*a* at the extreme end thereof. The shaft 34 is fitted through an aperture formed in holder 36. Holder 36 may be a commercially available side door elevator with a side door portion 36*a* which can be opened to receive shaft 34**, this side door being closable with a safety latch to insure proper holding action. A typical such elevator which may be employed is the type SLX side door elevator commercially available from B. J. Hughes Co., Houston, Tex.

A second such holder or elevator member 30 is provided, this holder member being fitted around casing 12 directly below collar 11 which is threadably attached to the casing. Link members 32 have eye portions **32*a* on the opposite ends thereof, these eye portions being fitted in the opposite apertured ends 36*b* and 30*b* of the holders 36 and 30 respectively. The casing 12 is thus suspended from oscillator 10 in tight engagement therewith, the top edge of holder member 30 abutting against collar 11 and the top edge of bulb portion 34*a* of shaft 34 abutting against the bottom edge of holder 36, thus providing tight acoustic coupling to the casing for the sonic energy generated by oscillator 10**.

An inlet for cement, water and mud that needs to be fed to casing 12 is provided by head member 13 which is threadably attached to collar 11. A cap **13*a* is threadably attached to head member 13 to seal off the top of this head member. This head can be removed to insert the wipers employed in carrying out the method of my U.S. Pat. No. 4,512,401. The cement, mud and water employed in carrying out this method are fed to head member 13 through flexible hoses 38** which are fabricated of a material such as rubber or plastic which is a poor conductor of sonic energy and thus operates to isolate such energy from the hoses and the apparatus to which such hoses are connected.

Sonic energy is thus efficiently transmitted down column 12 in carrying out the method described in my U.S. Pat. No. 4,512,401.

While the invention has been described and illustrated in detail, it is to be clearly understood that this invention is intended by way of illustration and example only and is not to be taken by way of limitation, the spirit and scope of this invention being limited only by the terms of the following claims.

I claim:

1. In a device for forming a cement annulus around the outer wall of a well casing, said device including means for generating sonic energy and a well casing to which said sonic energy is to be fed to effect a sealing bond between the cement and the casing, the improvement comprising means for coupling the sonic energy from a sonic generator to the casing comprising inlet means attached to the casing for feeding cement and other material into the casing, first holder means connected to the sonic energy generating means, second holder means connected to the casing at a point thereon below the inlet means, and link means for interconnecting said first and second holder means such that the sonic energy is fed directly from the oscillator through said holder and link means to the casing and bypassing the inlet means.

2. The device of claim 1 wherein the inlet means for feeding cement to said casing comprises sonic isolation means.

3. The device of claim 2 wherein said inlet means comprises an inlet head attached to the top end of the casing, said sonic isolation means comprises flexible hosing connected to the inlet head for feeding cement and other material thereto.

4. The device of claim 1 wherein said casing is suspended from said sonic energy generating means by means of said holder means and link means.

* * * * *